US005891827A

United States Patent [19]

Brust et al.

[11] Patent Number: 5,891,827

[45] Date of Patent: Apr. 6, 1999

[54] BACKING LAYER FOR RECEIVER USED IN THERMAL DYE TRANSFER

[75] Inventors: David P. Brust, Rochester; George B. Bodem, Pittsford, both of N.Y.; Wayne A. Bowman, Medina, Ohio

[73] Assignee: Eastman Kodak Company, Rochester, N.Y.

[21] Appl. No.: 979,512

[22] Filed: Nov. 26, 1997

[51] Int. Cl.[6] ..... B41M 5/035; B41M 5/38

[52] U.S. Cl. ..... 503/227; 428/195; 428/323; 428/331; 428/341; 428/913; 428/914

[58] Field of Search ..... 8/471; 428/195, 428/323, 331, 341, 913, 914; 503/227

[56] References Cited

U.S. PATENT DOCUMENTS

| | | | |
|---|---|---|---|
| 4,814,321 | 3/1989 | Campbell | 503/227 |
| 5,585,324 | 12/1996 | Martin et al. | 503/227 |

FOREIGN PATENT DOCUMENTS

| | | | |
|---|---|---|---|
| 0 781 665 A2 | 7/1997 | European Pat. Off. | 503/227 |

*Primary Examiner*—Bruce H. Hess
*Attorney, Agent, or Firm*—Harold E. Cole

[57] ABSTRACT

A dye-receiving element for thermal dye transfer comprising a support having on one side thereof a polymeric dye image-receiving layer and on the other side thereof a backing layer comprising a water-soluble polymeric binder, inorganic particles, and a cationic, polymeric mordant for anionic dyes.

20 Claims, No Drawings

BACKING LAYER FOR RECEIVER USED IN THERMAL DYE TRANSFER

FIELD OF THE INVENTION

This invention relates to dye-receiving elements used in thermal dye transfer, and more particularly to a backing layer for such elements capable of accepting writing.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of a cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements for thermal dye transfer generally comprise a transparent or reflective support having on one side thereof a dye image-receiving layer and on the other side thereof a backing layer. Writing on such a backing layer with pencils, ball point pens, solvent pens, rolling ball pens, and fountain pens is desirable, especially in the case of thermal dye transfer prints used in a postcard format. Pens, such as rolling ball and fountain pens, use aqueous inks of permanent and non-permanent (water-soluble) types. A backing layer for thermal dye transfer receivers that accepts and retains not only pencil and oily inks, but also water-based inks, is therefore desirable. Water-soluble inks are subject to running or smearing if contacted by moisture after drying. Such smearing of writing would be undesirable.

DESCRIPTION OF RELATED ART

U.S. Pat. No. 4,814,321 discloses the use of gelatin and 2 $\mu$m silica particles as an antistatic backing layer for a thermal dye transfer receiver. U.S. Pat. No. 5,585,324 and EPA 781,665 disclose the use of a backing layer which contains inorganic particles such as silica. While these backing layers accept pencil writing as well as ink from pens based on oily inks and water-based inks, there is a problem with them in that script made with pens using water-soluble inks exhibits severe smearing when the dried ink is contacted with water.

It is an object of this invention to provide a thermal dye-receiving element with a backing layer that can be written upon with pencil, oily ink pens, as well as with water-based ink pens. It is a further object of the invention to provide a thermal dye-receiving element with a backing layer so that writing made upon it with water-soluble inks will not smear or run when subjected to moisture after drying.

SUMMARY OF THE INVENTION

These and other objects are achieved in accordance with this invention which comprises a dye-receiving element for thermal dye transfer comprising a support having on one side thereof a polymeric dye image-receiving layer and on the other side thereof a backing layer comprising a water-soluble polymeric binder, inorganic particles, and a cationic, polymeric mordant for anionic dyes.

DESCRIPTION OF THE PREFERRED EMBODIMENTS

The polymeric binder in this invention can be any water-soluble polymer that is non-ionic or cationic. There can be used, for example, gelatin, cellulosic materials, such as hydroxypropyl methyl cellulose, polyacrylamide and its water-soluble N-substituted derivatives and copolymers, poly(vinyl alcohol) and its water-soluble copolymers and derivatives, polyvinylpyrrolidone and its water-soluble copolymers, colloidal albumin, and polysaccharides. In a preferred embodiment, gelatin is employed. The gelatin may be base-processed such as a lime-processed gelatin or acid-processed ossein gelatin.

The inorganic particles employed in the backing layer of the invention preferably comprise from about 5 to about 80 wt. % of the backing layer mixture of the invention. The inorganic particles preferably are capable of absorbing an oil at a ratio of not less than 100 cc/100 g and the mean particle diameter is preferably 0.2 to 20 $\mu$m. There may be used, for example, silica (crystalline and amorphous), hydrophilic silica, calcined clay, alumina, titanium dioxide, barium sulfate, etc. In a preferred embodiment, silica gel is employed.

The backing layer may be hardened with a crosslinking agent, if desired. For example, when gelatin is employed, hardeners such as 2,5-dihydroxy-1,3-dioxane, bis (vinylsulfonyl)-methane or bis(vinylsulfonyl)methyl ether may be used. For other useful hardeners, see U.S. Pat. No. 5,622,808, col. 3, the disclosure of which is hereby incorporated by reference.

Cationic, polymeric mordants used in accordance with the invention in a preferred embodiment are quaternary ammonium or phosphonium polymers. These mordants can be both water-soluble or water-insoluble. The water-insoluble mordants can be those soluble in water mixtures of lower alcohols; however, water-insoluble mordants that are water-dispersible are preferred. The types of water-dispersible mordants which are useful for this invention are disclosed in U.S. Pat. No. 3,958,995, the disclosure of which is hereby incorporated by reference. These mordants are water-dispersed, quaternary ammonium or phosphonium polymers which are crosslinked and may contain units derived from vinyl monomers. Such mordants generally have the formula:

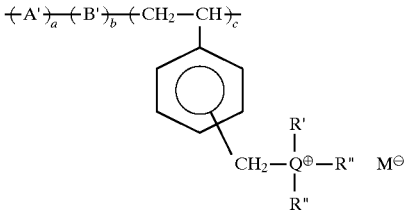

wherein

A' represents units of an addition-polymerizable monomer containing at least two ethylenically unsaturated groups, such as divinylbenzene, ethylene glycol diacrylate or N,N'-methylene-bisacrylamide;

B' represents units of a copolymerizable $\alpha,\beta$-ethylenically unsaturated monomer, such as styrene, vinyl acetate, methyl methacrylate, acrylonitrile, lower alkenes having from 1 to 6 carbon atoms or tetramethylbutadiene;

Q is N or P;

R', R", and R'" each independently represents a carbocyclic group such as aryl, aralkyl or cycloalkyl, e.g., benzyl, phenyl, p-methyl benzyl, cyclohexyl, cyclopentyl etc., or alkyl, preferably containing 1 to about 20 carbon atoms, such as methyl, ethyl, propyl, isobutyl, pentyl, hexyl, heptyl, decyl etc.;

M is an anion, such as halide, e.g., chloride or bromide, sulfate, acetate, alkane or arene sulfonate, e.g., p-toluene sulfonate;

a is from about 0.25 to 10 mole-%, preferably from about 1 to 10 mole-%;

b is from about 0 to 90 mole-%, preferably from about 0 to 60 mole-%; and c is from about 10 to 99 mole-%, preferably from about 40 to 99 mole-%.

For further polymer structures, see U.S. Pat. No. 5,622,808, column 2, the disclosure of which is hereby incorporated by reference.

Representative mordant polymers of the invention of the water-insoluble, water-dispersible type include the following:

M-1 poly(p-divinylbenzene-co-styrene-co-N-benzyl-N,N-dimethyl-N-vinylbenzylammonium chloride) x=b 49.5,y=49.5, z=1 mole-%.

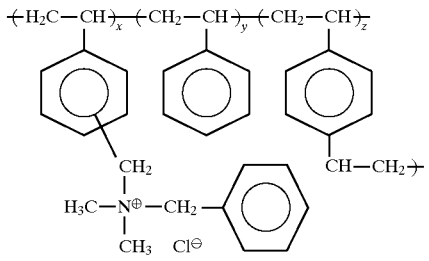

M-2 poly(N-vinylbenzyl-N,N,N-trimethyl ammonium chloride-co-ethylene glycol diacrylate). m=93, n=7 mole-%.

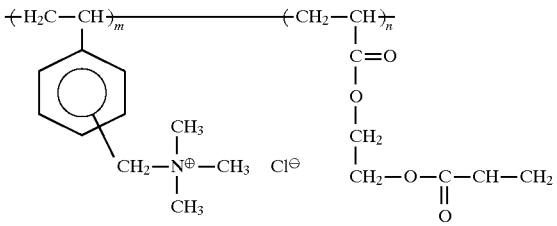

Examples of water-soluble polymers that are useful in the invention are:

M-3 poly(diallyl dimethyl ammonium chloride (Aldrich Chemical Co.)

M-4 poly(4-vinylbenzyl trimethyl ammonium chloride) (Polysciences, Inc.)

M-5 poly(methacryloxyethyl trimethyl ammonium bromide) (Polysciences, Inc.)

The backing layer of the invention can be coated in the amount ranging from about 0.1 g/m$^2$ to about 10 g/m$^2$, preferably from about 0.8 to about 3 g/m$^2$. The cationic, polymeric mordant is effective from about 1% by weight of the binder to 100% by weight of the binder in the backing layer, more preferably from 5% to 30% by weight of the binder.

The surface of the thermal receiver on which the backing layer is to be applied may be treated by corona discharge prior to coating of the backing layer of the invention. A subbing layer may also be employed.

A process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150; 4,965,238; 4,965,239; and 4,965,241, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at from about 1 to about 10 g/m$^2$. An overcoat layer may be further coated over the dye-receiving layer such as those described in U.S. Pat. No. 4,775,657, the disclosure of which is incorporated by reference.

Conventional dye-donor elements may be used with the dye-receiving element of the invention. Such donor elements generally comprise a support having thereon a dye-containing layer. Any dye may be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner.

The following examples are provided to further illustrate the invention.

EXAMPLES

Example 1

Dye-receiving elements were prepared with backing layers to establish writing properties and resistance to water-induced smearing of writing made with a water-soluble anionic ink applied by pen to the backing layers. A thermal dye transfer receiver as described in the example of U.S. application Ser. No. 08/663,960 of Campbell et al., filed Jun. 14, 1997, was treated with corona discharge on its polypropylene backside opposite to the receiving layers. Sample elements with the following backing layers were employed:

TABLE 1

| Element | Backing Layer Components (coated from water) | Dry Coverage g/m$^2$ |
|---|---|---|
| Control 1 | acid-processed gelatin | 1.72 |
| C-1 | silica, Sylojet P407 ®, 7 μm (Davison Grace) | 0.47 |
| | Fluortensid FT-248 ® surfactant (Bayer) | $1.61 \times 10^{-4}$ |
| | 2,5-dihydroxy-1,4-dioxane | 0.054 |
| E-1 | acid processed gelatin | 1.15 |
| | Sylojet P407 ® | 0.47 |
| | FT-248 ® | $1.61 \times 10^{-4}$ |
| | Mordant M-1 | 0.57 |
| | 2,5-dihydroxy-1,4-dioxane | 0.054 |
| E-2 | acid processed gelatin | 1.15 |
| | Sylojet P407 ® | 0.47 |
| | FT-248 ® | $1.61 \times 10^{-4}$ |
| | Mordant M-2 | 0.57 |
| | 2,5-dihydroxy-1,4-dioxane | 0.054 |

The coatings were made from water with an extrusion hopper applying 33.4 cc/m$^2$ of solution.

Each thermal dye-receiver element was evaluated for writing properties with pencil and a variety of pens including the Pilot Precise V7 fine rolling ball pen which applies a water-soluble (non-permanent) blue ink. The writing performance was categorized as A, B and C for each writing instrument. A means that writing proceeded smoothly to give a legible characters free of skips; B means the writing instrument wrote with some resistance but gave legible characters; and C means that the instrument was incapable of writing effectively on the backing layer. A rating of A or B is acceptable for practical use. See Table 2 for the evaluations.

The thermal dye-receiver elements were further evaluated for water resistance of characters applied on the backing layer with a Pilot Precise V7 fine rolling ball pen which applied a water-soluble blue ink which comprised a sulfonated, anionic dye. The backing layer was written upon with the water-soluble ink and the ink allowed to dry for several hours. The receiver was placed on a block at a 45° angle and 6 drops of deionized water were applied in succession immediately above the script and allowed to flow downward over the script. The excess water was shaken off and the sample placed flat to dry. The dry sample was inspected for smear of the ink and the result expressed as a yes or no in Table 2 designating smear observed or not observed, respectively.

TABLE 2

| | | Performance Characteristics | | | | | |
|---|---|---|---|---|---|---|---|
| Element | Mordant | #2 Pencil | Fountain Pen | Ball Point Pen | Solvent Pen (Stabilo) | Pilot Precise V7 blue | Water-Induced Smear (water-soluble ink) |
| C-1 | None | A | A | A | A | A | YES |
| E-1 | M-1 | A | A | A | A | A | NO |
| E-2 | M-2 | A | A | A | A | A | NO |

The results in Table 2 show that the thermal dye-receiver elements of the invention, E-1 and E-2, have good writing properties like that of the control C-1. However, the advantage of the invention compared to the control is shown by the total lack of water-induced smear in E-1 and E-2.

Example 2

Backing layer sample elements were coated to further illustrate the invention with water-soluble cationic mordants. The ability of these polymers in a gelatin-silica layer to prevent water-induced smear of a dried water-soluble ink was determined. The test was the same as that described above for Example 1. A comparison with a non-polymeric quaternary ammonium compound as well as a gelatin/silica control were also made.

Included in the tests as a comparison was the monomeric quaternary ammonium compound, M-6, octadecyl trimethyl ammonium bromide (Aldrich Chemical Co.).

The quaternary ammonium compounds were coated from an aqueous solution at 50.8 cc/$m^2$ to provide 0.43 g/$m^2$ of the mordant along with acid-processed gelatin at 1.73 g/$m^2$, Sylojet P407® silica at 0.47 g/$m^2$, 2,5-dihydroxy-1,4-dioxane at 0.054 g/$m^2$, and surfactant FT-248 at $1.61\times10^{-4}$ g/$m^2$. The coatings were made on a hand coating block on 102 $\mu$m thick polyester support (ESTAR®) carrying a subbing layer of poly(acrylonitrile-co-vinylidene chloride-co-acrylic acid). The coatings were dried at about 46° C. on the coating block, then the coatings were let stand overnight at 23° C. and about 50% RH before they were tested.

TABLE 3

| Writing Layer | Mordant | Water Induced Smear* |
|---|---|---|
| W-1 | M-1 | NO |
| W-2 | M-2 | NO |
| W-3 | M-3 | NO |
| W-4 | M-4 | NO |
| W-5 | M-5 | NO |
| W-6 (comparison) | M-6 | YES |
| W-7 (control) | NONE | YES |

*Writing done with Pilot Precise V7 fine blue rolling ball pen.

The data in Table 3 show that water-soluble quaternary ammonium polymers, M-3, M-4 and M-5, were as effective as the water-insoluble water-dispersed polymers M-1 and M-2 in preventing smearing of the dried water-soluble ink by water. However, a monomeric quaternary ammonium compound (M-6) was ineffective, as was the gelatin/silica control containing no quaternary ammonium compound.

Example 3

Backing layers utilizing the polymers M-1 and M-2 at various levels in gelatin/silica were made to further illustrate the invention. The coatings with M-2 were made as in Example 2 from aqueous solutions made to coat Sylojet P407® silica at 0.155 g/$m^2$, hardener at 3.1 wt-% of the gelatin, and $1.6\times10^{-4}$ g/$m^2$ FT248 surfactant. The coatings with M-1 were made similarly, but with Sylojet P407® at 0.47 g/$m^2$. All were coated on 102 $\mu$m thick polyester support carrying a subbing layer. The acid-processed gelatin and mordants were coated at levels to total together 1.72 g/$m^2$. A test to evaluate the smearing effect of water on the dried ink (dried overnight) from a Pilot Precise V7 rolling ball pen using water-soluble blue ink consisted of immersion of the written-upon coating in deionized water for 60 seconds. The excess water was shaken off and the samples allowed to dry lying flat. The following results were obtained:

TABLE 4

| Writing Layer | Gelatin g/$m^2$ | Mordant M-2 g/$m^2$ | Mordant M-1 g/$m^2$ | Water Smear |
|---|---|---|---|---|
| W-8 | 0.86 | 0.86 | — | NO |
| W-9 | 1.15 | 0.57 | — | NO |
| W-10 | 1.29 | 0.43 | — | NO |
| W-11 | 1.51 | 0.215 | — | NO |

TABLE 4-continued

| Writing Layer | Gelatin g/$m^2$ | Mordant M-2 g/$m^2$ | Mordant M-1 g/$m^2$ | Water Smear |
|---|---|---|---|---|
| W-12 | 1.61 | 0.108 | — | NO |
| W-13 (control) | 1.72 | 0 | — | YES |
| W-14 | 0.86 | — | 0.86 | NO |
| W-15 | 1.15 | — | 0.57 | NO |
| W-16 | 1.29 | — | 0.43 | NO |
| W-17 | 1.51 | — | 0.215 | NO |
| W-18 | 1.61 | — | 0.108 | Slight |
| W-19 | 1.67 | — | 0.054 | Slight |
| W-21 (control) | 1.72 | — | 0 | YES |

The data in Table 4 show that M-1 and M-2 were effective in preventing water smearing in these backing layers over a wide range of coverage. Also, all of these layers were rated A for writing with the instruments listed in Table 2.

Example 4

Backing layers utilizing water-soluble binders were prepared to further illustrate the invention. Water solutions were coated at 50.8 cc/$M^2$ to provide binder at 1.72 g/$m^2$, Sylojet P407® silica at 0.47 g/$m^2$, polymer M-2 at 0.43 g/$m^2$, and FT248 surfactant at $1.61\times10^{-4}$ g/$m^2$. The coatings were made on 102 $\mu$m polyester over a subbing layer of poly (acrylonitrile-co-vinylidene chloride-co-acrylic acid). The coatings were tested for writing properties with various writing instruments. The ratings of A, B, and C are as described for Example 1. The results are shown in Table 5.

The smearing by water of dried, water-soluble ink applied with a Pilot Precise V7 rolling ball pen was also tested by the application of six successive drops of water as described above for Example 1. A numerical rating on a scale of 0 to 4 was used to describe the results: a zero indicated no visible ink smear, 1=very slight, 2=slight, 3=moderate and 4=severe ink smear. The results are shown in Table 5.

The following binder polymers were utilized:

B-A poly(vinyl alcohol) 99% hydrolyzed, (Air Products and Chemicals Inc.)

B-B hydroxypropyl methyl cellulose, (Aldrich Chemical Co.)

B-C poly(2-ethyl-2-oxazoline) (Aldrich Chemical Co.)

B-D poly-acrylamide, molecular weight 10,000, (Aldrich Chemical Co.)

B-E silanol functionalized poly(vinyl alcohol) R1130 Kuraray Ltd.

B-F acid-processed gelatin

TABLE 5

Writing Performance

| Binder | Mordant | #2 Pencil Pen | Foun-tain Pen | Ball Point Pen | Solvent Pen Stabilo | Pilot Precise V7 Rolling Ball | Water Smear |
|---|---|---|---|---|---|---|---|
| B-A | M-2 | A | A | A | A | A | 1 |
| B-B | M-2 | A | A | A | A | A | 1 |
| B-C | M-2 | A | B | A | A | A | 1 |
| B-D | M-2 | A | A | A | A | A | 0 |
| B-E | M-2 | A | A | A | A | A | 2 |

TABLE 5-continued

| Binder | Mordant | Writing Performance: #2 Pencil Pen | Fountain Pen | Ball Point Pen | Solvent Pen Stabilo | Pilot Precise V7 Rolling Ball | Water Smear |
|---|---|---|---|---|---|---|---|
| B-F | M-2 | A | A | A | A | A | 0 |
| B-F* | M-2 | A | A | A | A | A | 0 |
| | Controls | | | | | | |
| B-A | None | A | C | A | A | C | 4 |
| B-B | None | A | A | A | A | A | 4 |
| B-C | None | A | A | A | A | A | 4 |
| B-D | None | A | A | A | A | A | 4 |
| B-E | None | A | C | A | A | C | 4 |
| B-F | None | A | A | A | A | A | 3 |
| B-F* | None | A | A | A | A | A | 4 |

*plus hardener

The results in Table 5 show that water-soluble binders other than gelatin can give good writing performance with silica and a mordant in the coating. The data also show that in other binders, the presence of a mordant eliminated or greatly reduced water-induced smearing compared to the performance when no mordant was used.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a polymeric dye image-receiving layer and on the other side thereof a backing layer comprising a water-soluble polymeric binder, inorganic particles, and a cationic, polymeric mordant for anionic dyes.

2. The element of claim 1 wherein said water-soluble polymeric binder is gelatin.

3. The element of claim 1 wherein said inorganic particles have a mean diameter of from about 0.2 to about 20 $\mu$m and are present in an amount of from about 5 to about 80 wt. % of said backing layer.

4. The element of claim 1 wherein said inorganic particles comprise silica gel.

5. The element of claim 1 wherein said cationic, polymeric mordant is a quaternary ammonium or phosphonium polymer.

6. The element of claim 1 wherein said cationic, polymeric mordant is present in an amount of 1 to 100% by weight of the binder.

7. The element of claim 1 wherein said cationic, polymeric mordant has the formula:

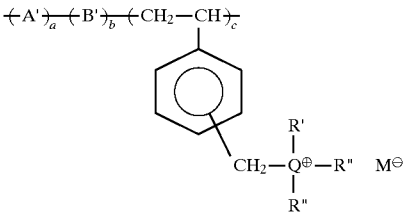

wherein

A' represents units of an addition-polymerizable monomer containing at least two ethylenically unsaturated groups;

B' represents units of a copolymerizable α,β-ethylenically unsaturated monomer;

Q is N or P;

R', R", and R'" are each independently carbocyclic or alkyl groups;

M is an anion;

a is from about 0.25 to 10 mole-%;

b is from about 0 to 90 mole-%; and c is from about 10 to 99 mole-%.

8. The element of claim 1 wherein the total coverage of said backing layer is from 0.1 to 10 g/m$^2$.

9. A process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye layer so that the dye layer of said dye-donor element faces said dye image-receiving layer of said dye-receiving element; and (c) imagewise-heating said dye-donor element and thereby transferring a dye image to said individual dye-receiving element;

wherein said backing layer comprises a water-soluble polymeric binder, inorganic particles, and a cationic, polymeric mordant for anionic dyes.

10. The process of claim 9 wherein said water-soluble polymeric binder is gelatin.

11. The process of claim 9 wherein said inorganic particles have a mean diameter of from about 0.2 to about 20 $\mu$m and are present in an amount of from about 5 to about 80 wt. % of said backing layer.

12. The process of claim 9 wherein said cationic, polymeric mordant is a quaternary ammonium or phosphonium polymer.

13. The process of claim 9 wherein said cationic, polymeric mordant has the formula:

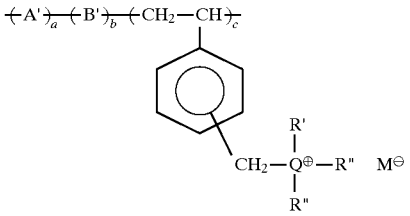

wherein

A' represents units of an addition-polymerizable monomer containing at least two ethylenically unsaturated groups;

B' represents units of a copolymerizable α,β-ethylenically unsaturated monomer;

Q is N or P;

R', R", and R'" are each independently carbocyclic or alkyl groups;

M is an anion;

a is from about 0.25 to 10 mole-%;

b is from about 0 to 90 mole-%; and c is from about 10 to 99 mole-%.

14. The process of claim 9 wherein said inorganic particles comprise silica gel.

15. A thermal dye transfer assemblage comprising:

a) a dye-donor element comprising a support having thereon a dye layer, and b) a dye-receiving element comprising a support having thereon a dye image-receiving layer;

said dye-receiving element being in a superposed relationship with said dye-donor element so that said dye layer of said dye-donor element is in contact with said dye image-receiving layer of said dye-receiving element, said dye-donor element having on the other side thereof a backing layer comprising a water-soluble polymeric binder, inorganic particles, and a cationic, polymeric mordant for anionic dyes.

16. The assemblage of claim 15 wherein said water-soluble polymeric binder is gelatin.

17. The assemblage of claim 15 wherein said inorganic particles have a mean diameter of from about 0.2 to about 20 $\mu$m and are present in an amount of from about 5 to about 80 wt. % of said backing layer.

18. The assemblage of claim 15 wherein said cationic, polymeric mordant is a quaternary ammonium or phosphonium polymer.

19. The assemblage of claim 15 wherein said cationic, polymeric mordant has the formula:

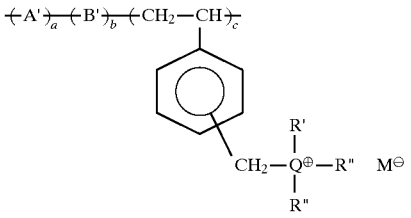

wherein

A' represents units of an addition-polymerizable monomer containing at least two ethylenically unsaturated groups;

B' represents units of a copolymerizable $\alpha,\beta$-ethylenically unsaturated monomer;

Q is N or P;

R', R", and R'" are each independently carbocyclic or alkyl groups;

M is an anion;

a is from about 0.25 to 10 mole-%;

b is from about 0 to 90 mole-%; and c is from about 10 to 99 mole-%.

20. The assemblage of claim 15 wherein said inorganic particles comprise silica gel.

* * * * *